US010784566B1

(12) United States Patent
Chang et al.

(10) Patent No.: US 10,784,566 B1
(45) Date of Patent: Sep. 22, 2020

(54) WIRELESS DEVICE

(71) Applicant: WISTRON NEWEB CORPORATION, Hsinchu (TW)

(72) Inventors: Jui-Chih Chang, Hsinchu (TW); Wei-Kai Chen, Hsinchu (TW); Yu-Hsiang Chang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 16/571,269

(22) Filed: Sep. 16, 2019

(30) Foreign Application Priority Data

Mar. 27, 2019 (TW) ..... 108110698 A

(51) Int. Cl.
*H01Q 1/24* (2006.01)
*H01Q 1/52* (2006.01)
*H01Q 25/00* (2006.01)

(52) U.S. Cl.
CPC ..... *H01Q 1/243* (2013.01); *H01Q 1/525* (2013.01); *H01Q 25/005* (2013.01)

(58) Field of Classification Search
CPC ..... H01Q 1/243; H01Q 1/525; H01Q 25/005
See application file for complete search history.

(56) References Cited

U.S. PATENT DOCUMENTS 7,123,941 B2 * 10/2006 Fukuhara ..... H01Q 1/246 455/562.1
9,692,112 B2 6/2017 Ying et al.
2009/0027209 A1 * 1/2009 Amir ..... H01Q 1/2216 340/572.7
2009/0267849 A1 * 10/2009 Yun ..... H01Q 1/521 343/727
2011/0095961 A1 * 4/2011 Johansson ..... H01Q 1/246 343/893
2011/0193652 A1 8/2011 Wu
2019/0214721 A1 * 7/2019 Hu ..... H01Q 1/2266
2020/0106193 A1 * 4/2020 Thyagarajan ..... H01Q 9/0428

FOREIGN PATENT DOCUMENTS

CN 204947078 U 1/2016
EP 2023436 A1 2/2009
WO 2019025006 A1 2/2019

* cited by examiner

*Primary Examiner* — Nguyen T Vo
(74) *Attorney, Agent, or Firm* — McClure, Qualey & Rodack, LLP

(57) ABSTRACT

A wireless device includes a first transceiver circuit, a power splitter, a first directional antenna, and a second directional antenna. The first directional antenna is connected to a second end of the power splitter and has a first feeding portion and a first radiation unit, and the first feeding portion has a first line length. The second directional antenna is connected to a third end of the power splitter and has a second feeding portion and a second radiation unit, and the second feeding portion has a second line length. A phase difference is provided between the first directional antenna and the second directional antenna. The first transceiver circuit forms, through the first directional antenna, the second directional antenna and the predetermined phase difference, a predetermined pattern to transmit or receive signals, and the predetermined pattern has omnidirectionality.

11 Claims, 16 Drawing Sheets

WIRELESS DEVICE

CROSS-REFERENCE TO RELATED PATENT APPLICATION

This application claims the benefit of priority to Taiwan Patent Application No. 108110698, filed on Mar. 27, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a wireless device, and more particularly to a wireless device capable of providing an omnidirectional pattern.

BACKGROUND OF THE DISCLOSURE

Conventional smart speakers access the Internet through Wi-Fi access points (APs) in a wireless LAN (WLAN) in homes, and are rarely provided with the function of access points to provide for other devices to access the Internet in homes, while being paired with peripheral devices through Bluetooth® to play high-resolution music. The difficulty lies in the fact that a Wi-Fi 2.4G wireless local area network of the smart speaker needs to transmit signals for longer periods of time, which causes interference to the Bluetooth® devices operating in the same frequency band (an operating band of the Bluetooth® is about 2.4G~2.485 GHz), so that an effective distance for playing music becomes shorter when the Bluetooth® devices are paired through the Bluetooth®.

In addition, for some users who need to play high-resolution music, the Bluetooth® Digital Transmission Specification, Advanced Audio Distribution Profile (A2DP), is required. However, the specification does not support a retransmission mechanism. In other words, when 2.4G WiFi/Bluetooth® are used to transmit data in Time Division Duplex (TDD), once the Bluetooth® stops transmitting, an issue of audio interruption may arise.

Furthermore, conventional smart speakers usually use Inverted F-Antenna (IFA) for Bluetooth® and 2.4G Wi-Fi transmission. However, null points often show in a direction along a circuit board of the conventional smart speakers, and blind spots in the horizontal plane for the pattern of the antenna cannot be eliminated. Moreover, since the circuit board is part of the antenna, an isolation performance between the Bluetooth® and Wi-Fi is generally poor.

Under the premise of miniaturization, there is almost no metal-free barrier space for designing omnidirectional antennas. Moreover, considering the limitation that existing Bluetooth® chips are mostly designed with a single transceiver, it is also difficult to use multiple transceivers with multiple antennas to overcome issues relating to antenna omnidirectionality when there is a metal barrier space.

Therefore, how the structure and circuit design in a wireless device can be improved to provide an omnidirectional antenna pattern and maintain an isolation between the Bluetooth® antenna and the Wi-Fi antenna to overcome the above drawbacks while providing functions of smart speakers and Wi-Fi access points for the wireless device at the same time has become one of the important issues to be solved in the art.

SUMMARY OF THE DISCLOSURE

In response to the above-referenced technical inadequacies, the present disclosure provides a wireless device capable of providing an omnidirectional pattern.

In one aspect, the present disclosure provides a wireless device including a first transceiver circuit, a power splitter, a first directional antenna, and a second directional antenna. The first transceiver circuit has a transmission and reception sharing port, and the power splitter includes a first end, a second end, and a third end, and the first end is connected to the transmitting and receiving sharing port. The first directional antenna is connected to the second end of the power splitter, and has a first feeding portion and a first radiation unit, and the first feeding portion has a first line length. The second directional antenna is connected to the third end of the power splitter, and has a second feeding portion and a second radiation unit, the second feeding portion has a second line length, and a phase difference is provided between the first directional antenna and the second directional antenna. The first transceiver circuit forms, through the first directional antenna, the second directional antenna and the predetermined phase difference, a predetermined pattern to transmit or receive signals, and the predetermined pattern has omnidirectionality.

Therefore, the present disclosure adopts a design including two directional antennas, and interference between subsystems with the same frequency in a single system is reduced by the high directivity of the single antenna to increase the distance of wireless transmission. Moreover, the characteristic of the antenna performance not being affected by the main circuit board and the metal barrier can be utilized. Therefore, the two directional antennas can be placed on the main circuit board or respectively on either side of any metal object, and connected by coaxial wires with different lengths and splitters, thereby feeding therefrom to generate a predetermined phase difference and allowing a pattern combined by the two directional antennas to be approximately an omnidirectional pattern.

In addition, isolators are further provided in the wireless device to achieve a predetermined isolation, and the wireless device of the present disclosure can increase a coexistence performance of systems when the size of a product is greatly reduced, and further allow the wireless device of the present disclosure to be more competitive.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
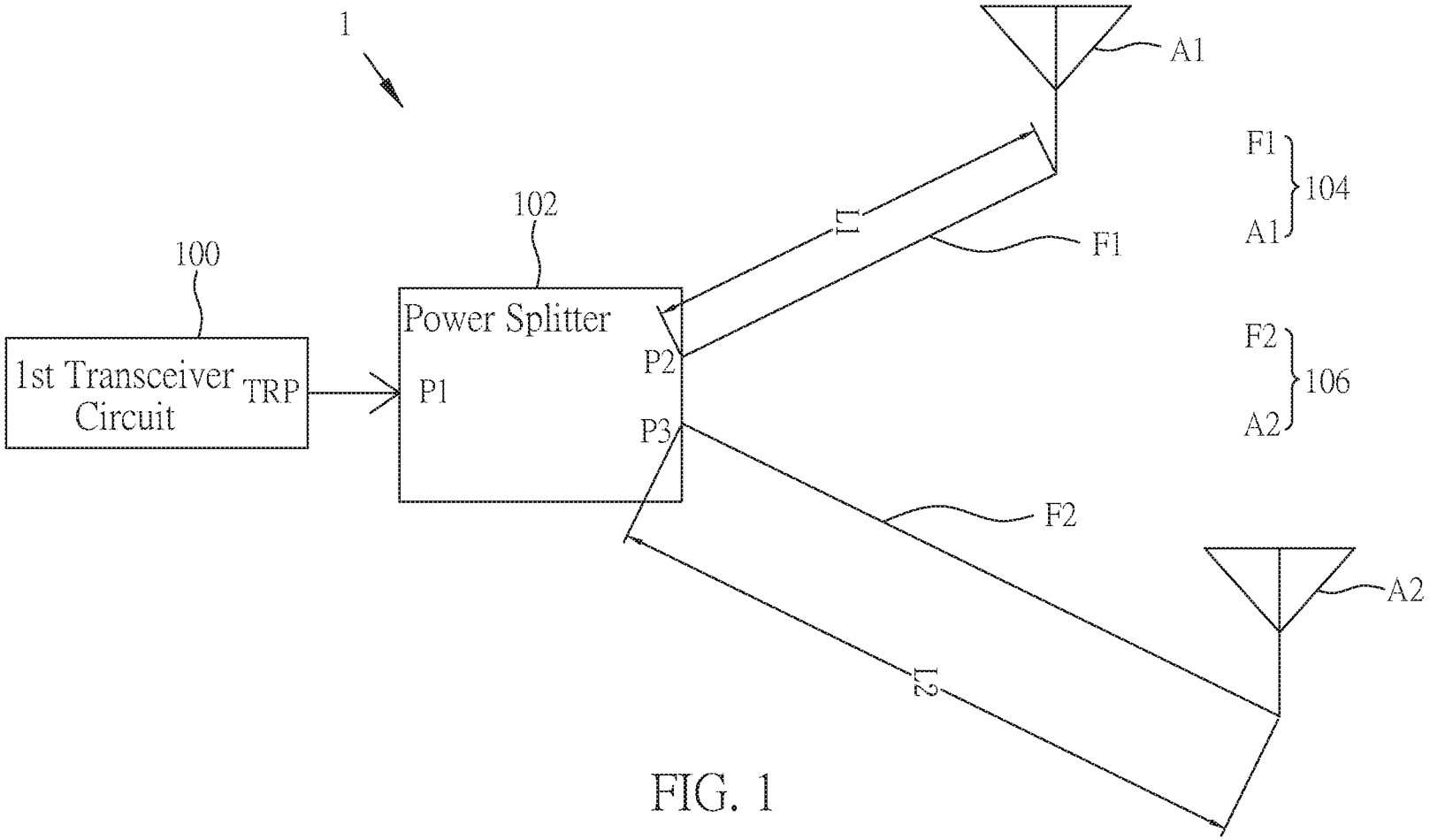
FIG. 1 is a block diagram showing a wireless device according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1, which is a block diagram showing a wireless device according to an embodiment of the present disclosure. An embodiment of the present disclosure provides a wireless device 1 including a first transceiver circuit 100, a power splitter 102, a first directional antenna 104, and a second directional antenna 106. The first transceiver circuit 100 has a transmission and reception sharing port TRP, the power splitter 102 includes a first terminal P1, a second terminal P2 and a third terminal P3, and the first terminal P1 is connected to the transmission and reception sharing port TRP.

Here, the first transceiver circuit 100 can be a Bluetooth® transceiver, which is usually only configured with a single connection port for transmitting and receiving data. It can be seen from the circuit that an existing RF circuit used by the Bluetooth® transceiver is only a transmitter/receiver end (TX/RX) with a single channel.

Further, the first directional antenna 104 is connected to the second end P2 of the power splitter 102, and has a first feeding portion F1 and a first radiation unit A1, and the first feeding portion F1 has a first line length L1.

On the other hand, the second directional antenna 106 is opposite to the first directional antenna 104 and connected to the third end P3 of the power splitter 102, and the second directional antenna 106 has a second feeding portion F2 and a second radiation unit A2. The second feeding portion F2 has a second line length L2, and a predetermined phase difference is provided between the first directional antenna 104 and the second directional antenna 106. The first transceiver circuit 100 forms, through the first directional antenna 104, the second directional antenna 106 and the predetermined phase difference, a predetermined pattern to transmit or receive signals, and the predetermined pattern has omnidirectionality. In detail, radiation directions of the first directional antenna 104 and the second directional antenna 106 are different. For example, the radiation directions of the first directional antenna 104 and the second directional antenna 106 may be defined as peak gain directions in the radiation pattern, and for example, may be in opposite directions. Furthermore, the formed predetermined pattern may be an approximately omnidirectional pattern, in other words, a radiation pattern of the predetermined pattern has no apparent dead spot and may be, for example, circular, oval, or the like.

Referring to FIG. 1, when a signal starts from the first transceiver circuit 100, a splitter needs to be added to the single-channel RF system to transmit and receive signals for the two antennas at the circuit end. Therefore, by providing the power splitter 102, the signal from the first transceiver circuit 100 is split into two signals. Here, the power splitter 102 can be a Wilkinson splitter or a T-junction splitter, or a plurality of reserved power splitters 102 can be provided, thus subsequent design changes can be made according to product requirements.

Next, in a circuit design of this embodiment, two directional antennas are arranged, one of which is formed by a change in line length to form the predetermined phase difference, for example, one of the paths falls behind with a specific angle, and two directional antennas having directivities with the predetermined phase difference are then connected to make the pattern approximate omnidirectionalilty. The predetermined phase difference varies based on directions that the antennas are placed and the polarization, and typically is 0 degrees or 180 degrees. In an embodiment of the present disclosure, the predetermined phase difference may range from −30 degrees to 30 degrees or from 150 degrees to 210 degrees.

Figure 2B:
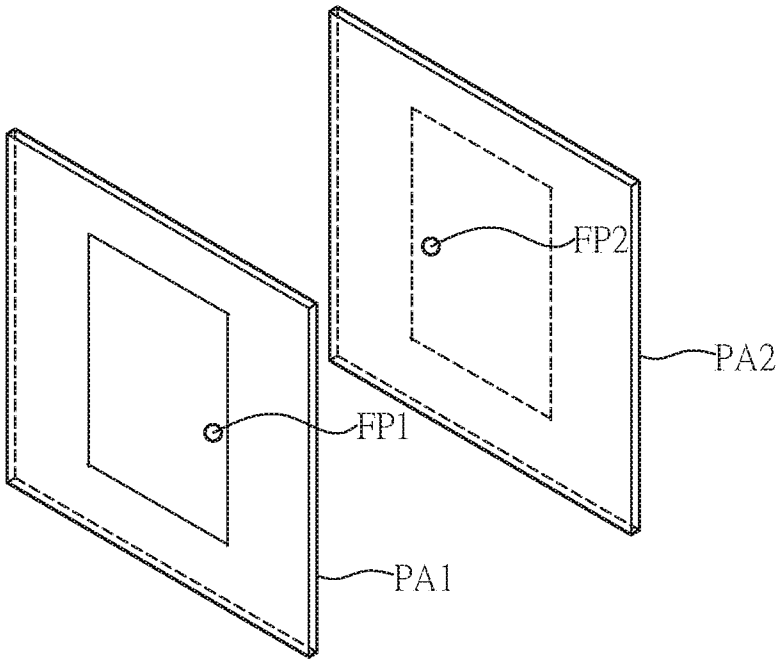
FIGS. 2A to 2D are schematic diagrams showing feeding directions of patch antennas according to an embodiment of the present disclosure.
Figure 2A:
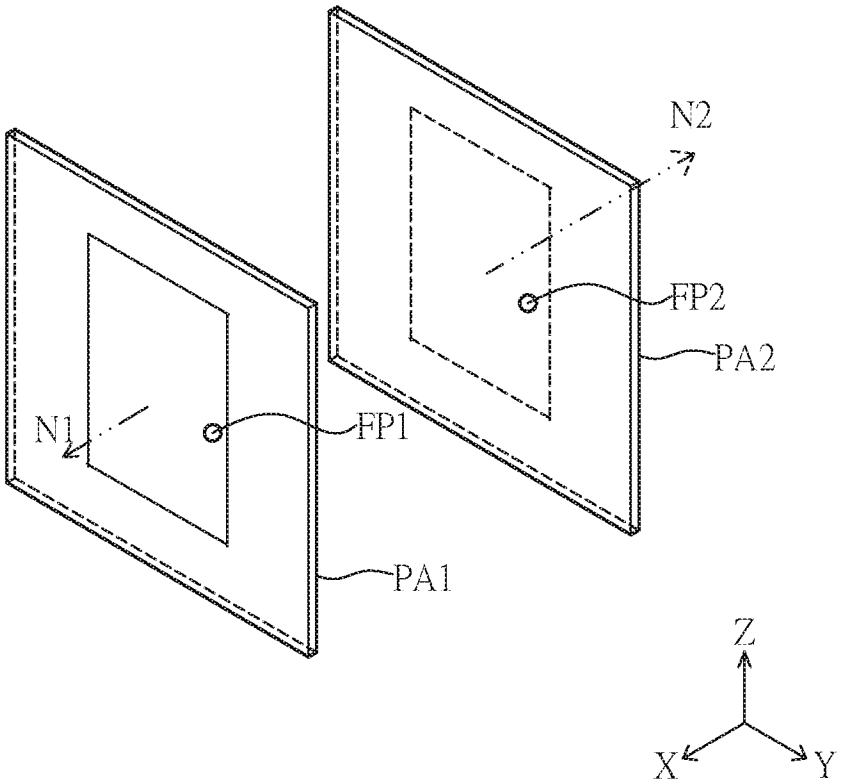
Figure 2D:
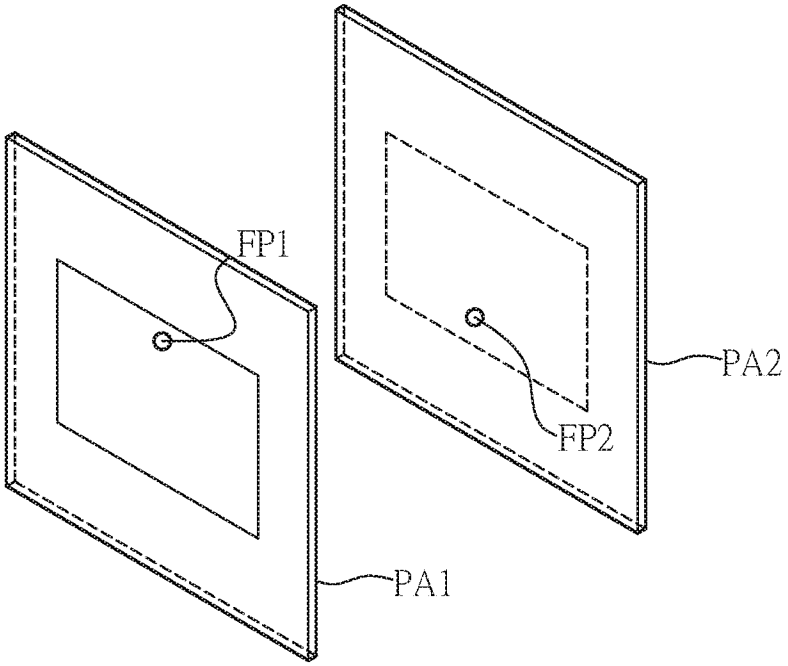
Figure 2C:
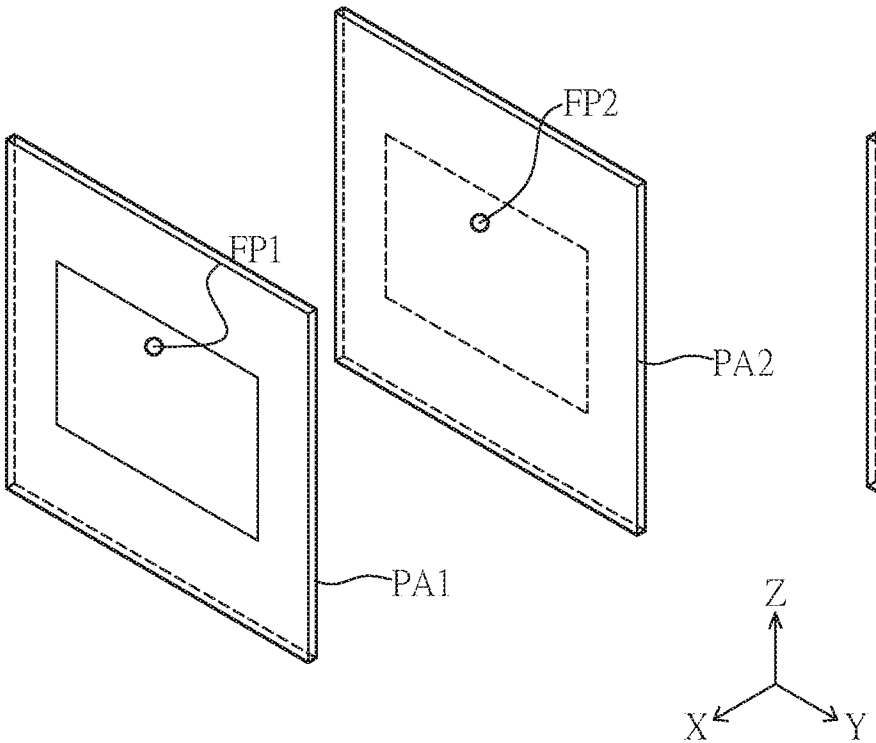
Figure 3:
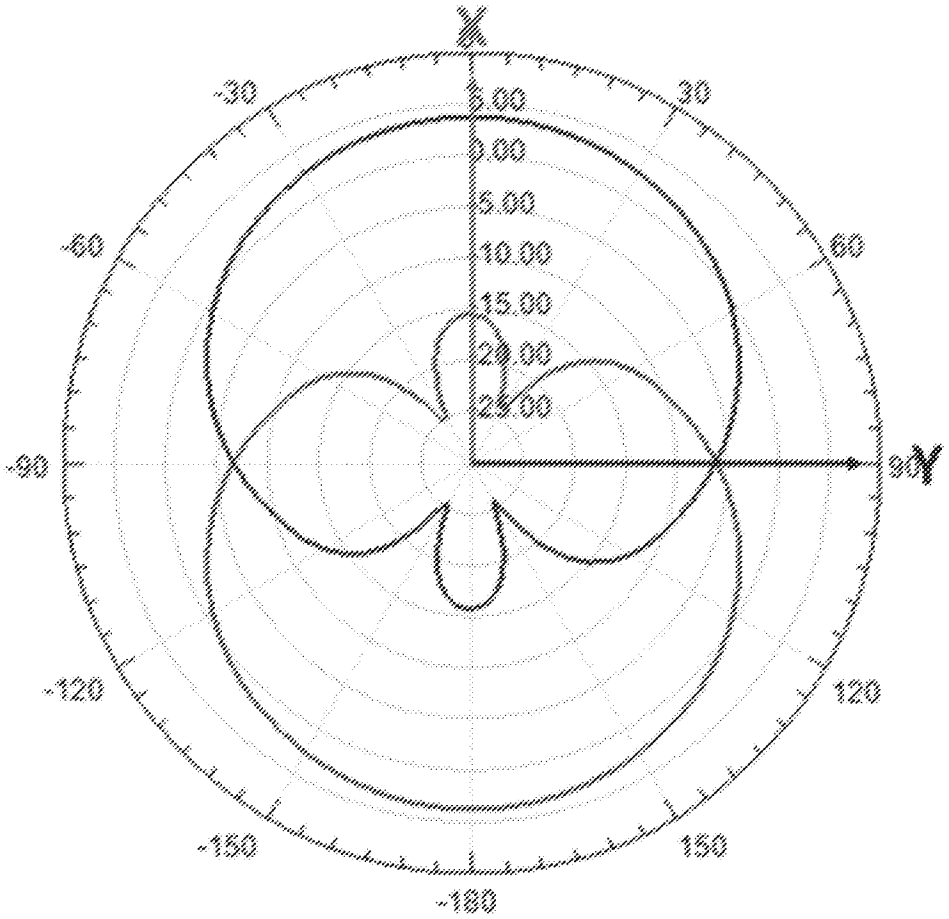
FIG. 3 is a schematic diagram showing individual feeding patterns of horizontally polarized patch antennas according to an embodiment of the present disclosure.

Reference is made to FIGS. 2A to 3, which are schematic diagrams showing feeding directions of patch antennas according to an embodiment of the present disclosure. Specifically, different feeding directions and polarizations require different phase differences, the purpose of which is to form constructive interference in a Y direction where null points happen. In this embodiment, the first radiation unit A1 and the second radiation unit A2 are a first patch antenna PA1 and a second patch antenna PA2, respectively, and a normal direction N1 of the first patch antenna PA1 and a normal direction N2 of the second patch antenna PA2 are opposite to each other.

In detail, for the patch antenna, a direction of polarization depends on a position of a feeding point. The first patch antenna PA1 and the second patch antenna PA2 of FIGS. 2A and 2B are horizontally polarized. The first feeding portion F1 includes a first feeding point FP1 having a first feeding direction with respect to the first radiation unit A1, and the second feeding portion F2 includes a second feeding point FP2 having a second feeding direction with respect to the second radiation unit A2. As shown in FIG. 2A, referring to positions of the first feeding point FP1 and the second feeding point FP2, the first feeding direction is oriented in a −Y direction, and the second feeding direction is also oriented in the −Y direction, and therefore the first feeding direction is the same as the second feeding direction. When the polarization directions of the first patch antenna PA1 and the second patch antenna PA2 are horizontally polarized, the first line length L1 is different from the second line length L2 to form the predetermined phase difference, and the predetermined phase difference ranges from 150 degree to 210 degrees, preferably 180 degrees.

As shown in FIG. 2B, referring to the positions of the first feeding point FP1 and the second feeding point FP2, the first feeding direction is oriented in the −Y direction, and the second feeding direction is oriented in a +Y direction, and therefore the first feeding direction is opposite to the second feeding direction. Here, when the polarization directions of the first patch antenna PA1 and the second patch antenna PA2 are horizontally polarized, the first line length L1 is the same as the second line length L2 to form the predetermined phase difference of 0 degrees. It should be noted that the first line length L1 and the second line length L2 can be designed with different lengths to form the same predetermined phase difference of 0 degrees. In another embodiment, the predetermined phase difference may range from −30 degrees to +30 degrees, and preferably 0 degrees.

On the other hand, cases of vertically polarization can be referred to in FIGS. 2C and 2D. As shown in FIG. 2C, referring to the positions of the first feeding point FP1 and the second feeding point FP2, the first feeding direction is oriented in a −Z direction, and the second feeding direction is also oriented in the −Z direction, so that the first feeding direction is the same as the second feeding direction. When the polarization directions of the first patch antenna PA1 and the second patch antenna PA2 are vertically polarized, the first line length L1 is the same as or different from the second line length L2 to form a predetermined phase difference, which ranges from −30 degrees to +30 degrees, and preferably 0 degrees.

As shown in FIG. 2D, referring to the positions of the first feeding point FP1 and the second feeding point FP2, the first feeding direction is oriented in the −Z direction, and the second feeding direction is oriented in a +Z direction, and therefore the first feeding direction is opposite to the second feeding direction. Here, when the polarization directions of the first patch antenna PA1 and the second patch antenna PA2 are vertically polarized, the first line length L1 is different from the second line length L2 to form a predetermined phase difference which ranges from 150 degree to 210 degrees, preferably 180 degrees.

Figure 4A:
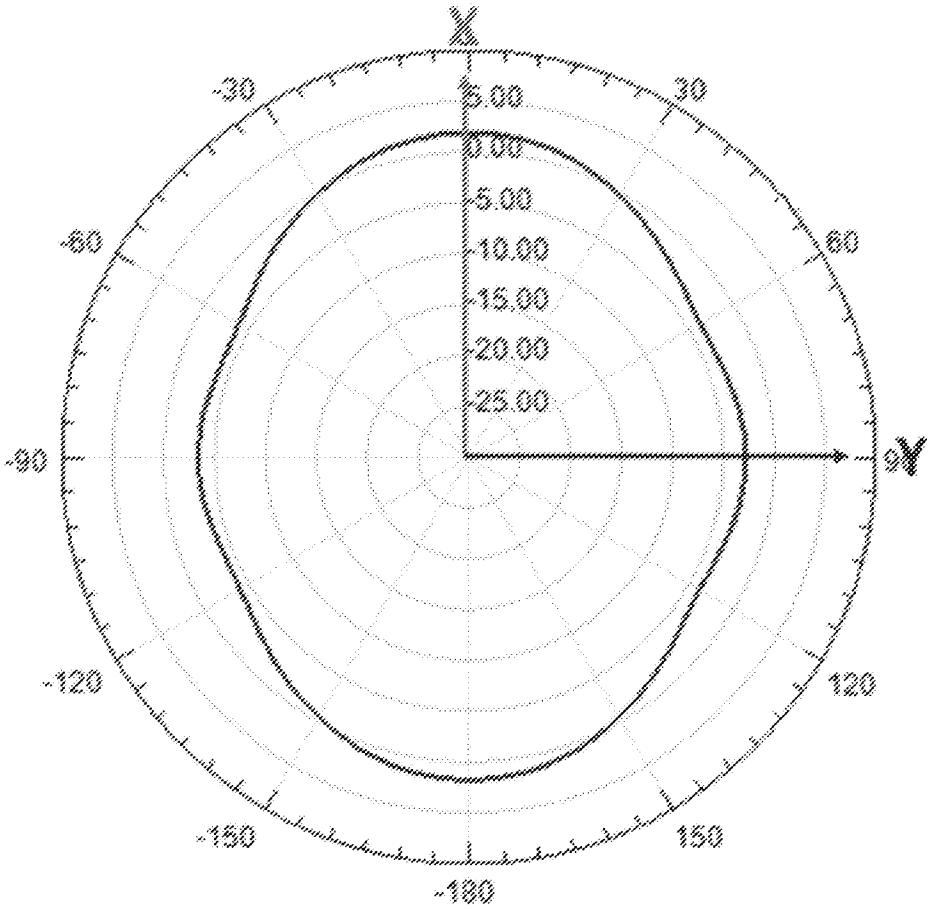
FIG. 4A is a schematic diagram of patterns of horizontally polarized patch antennas fed in the same direction with a predetermined phase difference of 180 degrees according to an embodiment of the present disclosure.

Reference is now made to FIGS. 3 and 4A, which are schematic diagrams showing individual feeding patterns of horizontally polarized patch antennas and a schematic diagram of patterns of horizontally polarized patch antennas fed in the same direction with a predetermined phase difference according to an embodiment of the present disclosure. Taking for example 2.45 GHz horizontally polarized patch antennas fed in the same directions in a Bluetooth® band, and with the individual feeding patterns being shown in FIG. 3, the single patch antenna can only provide the pattern of one side, so that full orientational coverage can be provided by two back-to-back patch antennas. When the patch antennas are made to have a predetermined phase difference, for example, 180 degrees, and the feeding directions are the same, as shown by the patterns thereof in FIG. 4A, dead spots along sides of the patch antennas are obviously eliminated, and the patch antennas with the predetermined phase difference have a nearly omnidirectional pattern.

Figure 4B:
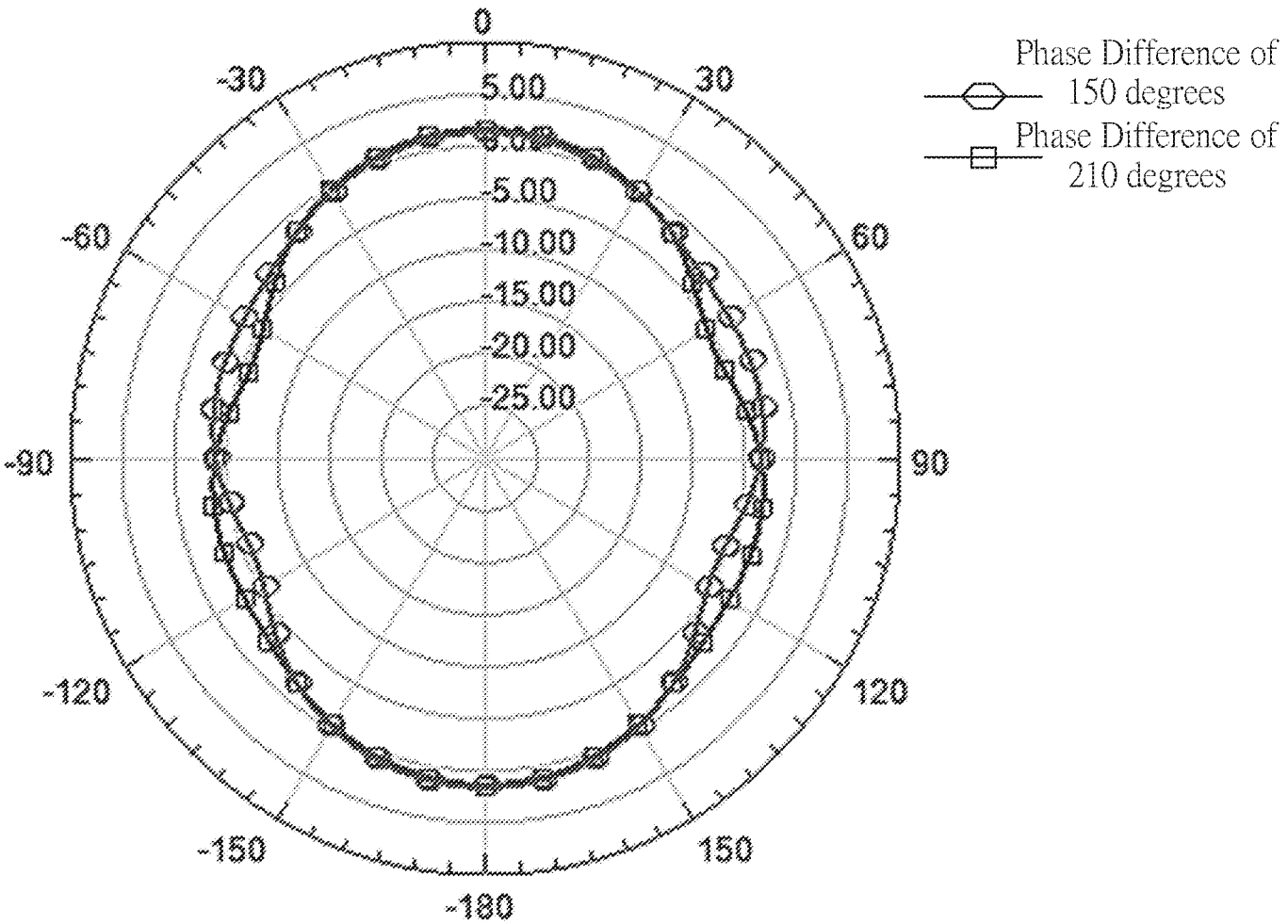
FIG. 4B is a schematic diagram of field patterns of horizontally polarized patch antennas fed in the same direction with a predetermined phase difference of 150 degrees and 210 degrees according to an embodiment of the present disclosure.

On the other hand, referring to FIG. 4B, which is a schematic diagram of field patterns of horizontally polarized patch antennas fed in the same direction with a predetermined phase difference of 150 degrees and 210 degrees according to an embodiment of the present disclosure. As shown in FIG. 4B, when the first line length L1 and the second line length L2 form a predetermined phase difference of 180 degrees and 210 degrees, the first patch antenna PA1 and the second patch antenna PA2 are fed in the same directions, and the polarization directions are horizontally polarized, predetermined patterns having omnidirectionality can be obtained, respectively.

Figure 4C:
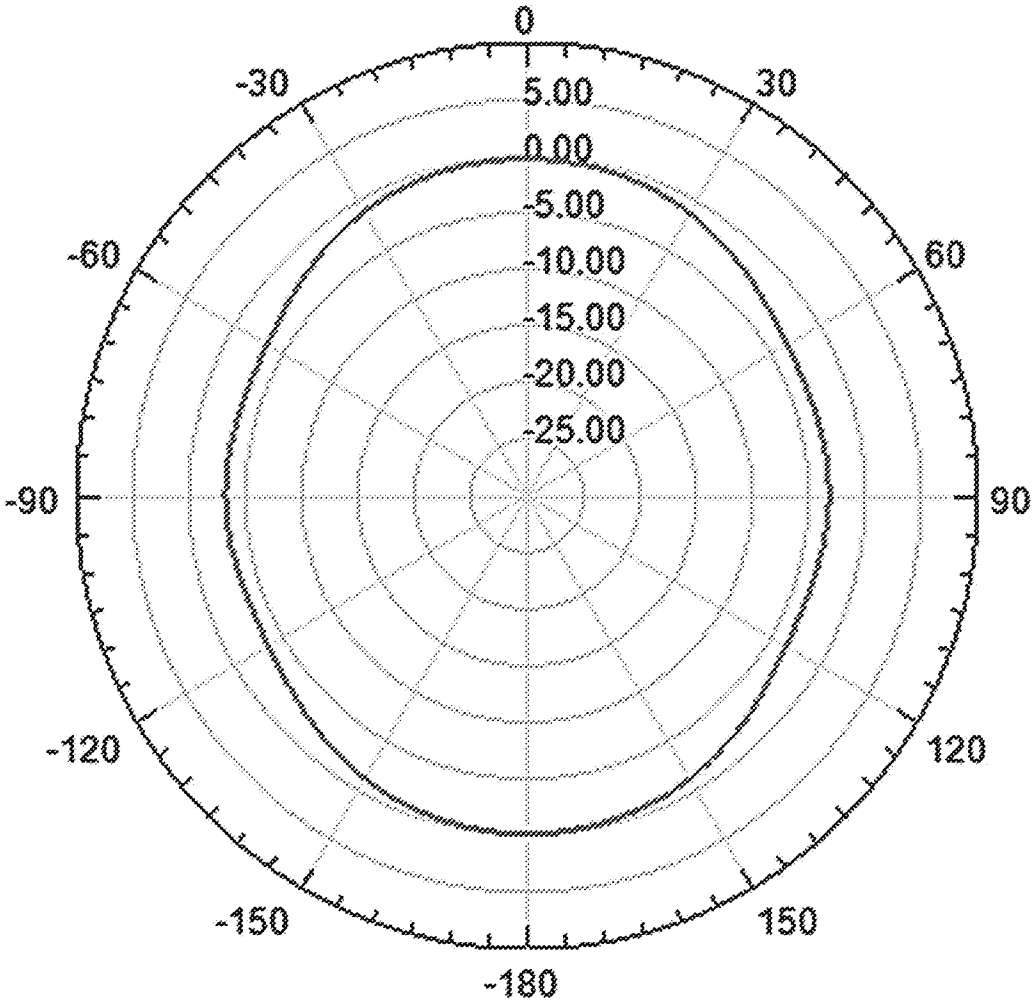
FIG. 4C is a schematic diagram of a field pattern of vertically polarized patch antennas fed in the same direction with a predetermined phase difference of 0 degree according to an embodiment of the present disclosure.

Referring to FIG. 4C, which is a schematic diagram of a field pattern of vertically polarized patch antennas fed in the same direction with a predetermined phase difference of 0 degrees according to an embodiment of the present disclosure. As shown in FIG. 4C, when the first line length L1 and the second line length L2 form a predetermined phase difference of 0 degrees, the first patch antenna PA1 and the second patch antenna PA2 are fed in the same directions, and the polarization directions are vertically polarized, a predetermined pattern having omnidirectionality can be obtained.

Figure 4D:
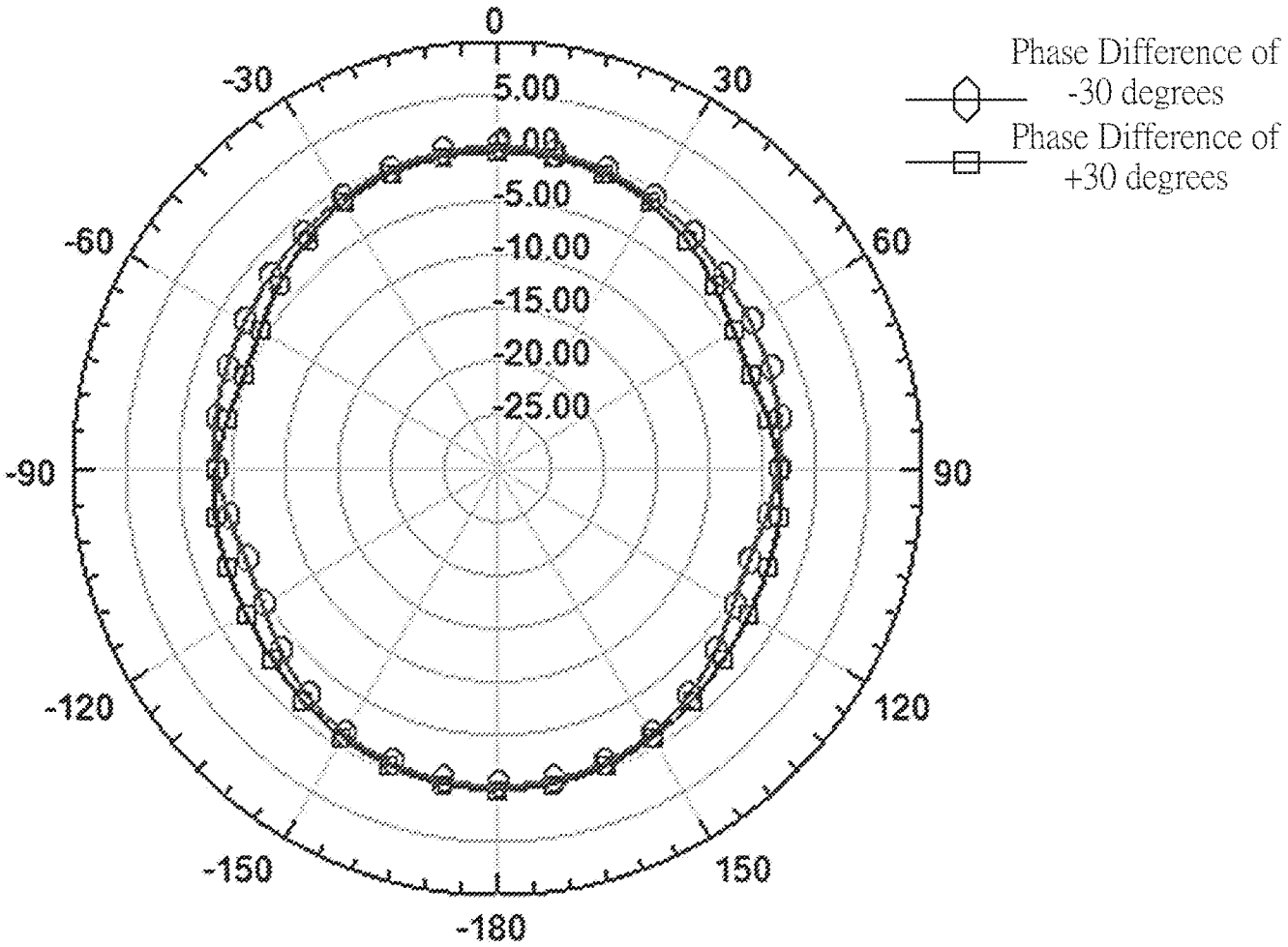
FIG. 4D is a schematic diagram of field patterns of vertically polarized patch antennas fed in the same direction with a predetermined phase difference of +30 degrees and −30 degrees according to an embodiment of the present disclosure.

In addition, referring to FIG. 4D, a schematic diagram of field patterns of vertically polarized patch antennas fed in the same direction with a predetermined phase difference of +30 degrees and −30 degrees according to an embodiment of the present disclosure is shown. As shown in FIG. 4D, when the first line length L1 and the second line length L2 form a predetermined phase difference of +30 degrees and −30 degrees, the first patch antenna PA1 and the second patch antenna PA2 are fed in the same directions, and the polarization directions are vertically polarized, predetermined patterns having omnidirectionalities can be obtained, respectively.

Figure 5:
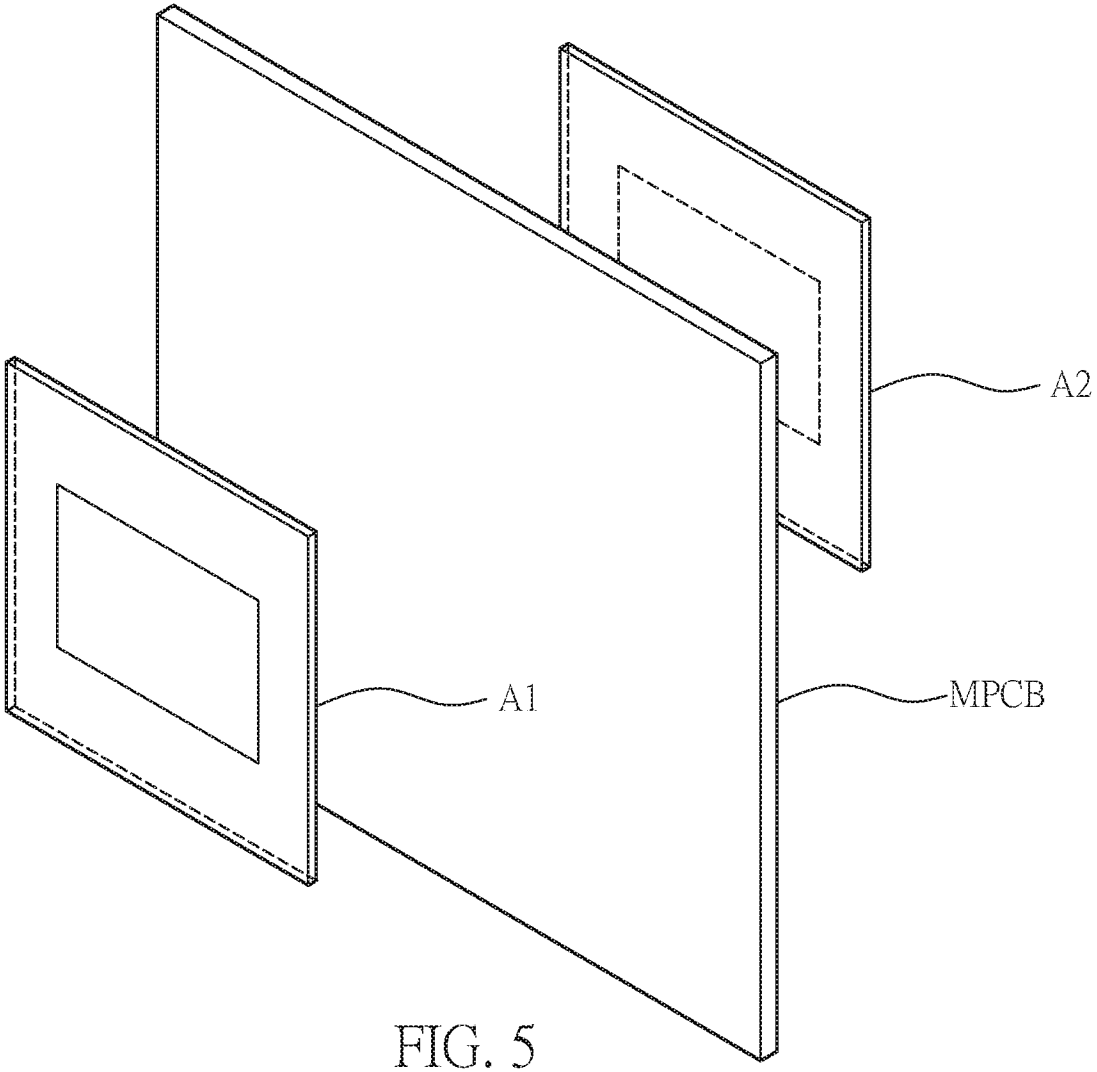
FIG. 5 is a schematic diagram showing a configuration of a radiation unit and a main circuit board of the wireless device of the present disclosure.

Reference is made to FIG. 5, which is a schematic diagram showing a configuration of a radiation unit and a main circuit board of the wireless device of the present disclosure. When designing a product, an entire layer needs to be preserved for a metal forbidden zone to achieve an antenna field without dead spots. However, a size of the product may be significantly increased, accordingly.

Figure 6:
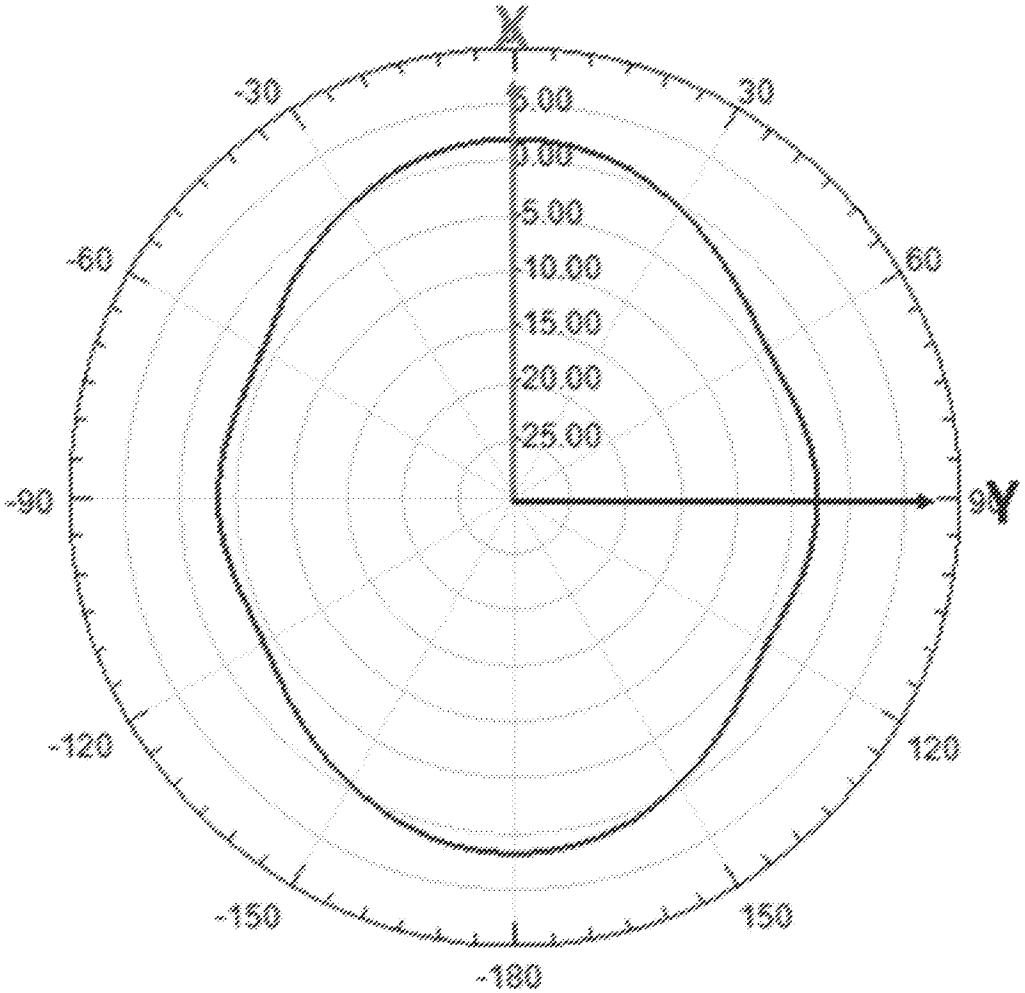
FIG. 6 is a schematic diagram of patterns in which horizontally polarized patch antennas are provided with the main circuit board and fed in the same direction with a predetermined phase difference of 180 degrees according to an embodiment of the present disclosure.

As shown in FIG. 5, the wireless device 1 further includes a main circuit board MPCB disposed between the first radiation unit A1 and the second radiation unit A2, and the first transceiver circuit 100 can be disposed on the main circuit board MPCB. Similarly, reference is made to FIG. 6, which is a schematic diagram of patterns in which horizontally polarized patch antennas are provided with the main circuit board and fed with a predetermined phase difference according to an embodiment of the present disclosure. By using the architecture of the present disclosure, the circuit board can be placed between the two radiation units, while ensuring the omnidirectional characteristics for the pattern without reserving any layer for the metal forbidden zone.

Figure 7A:
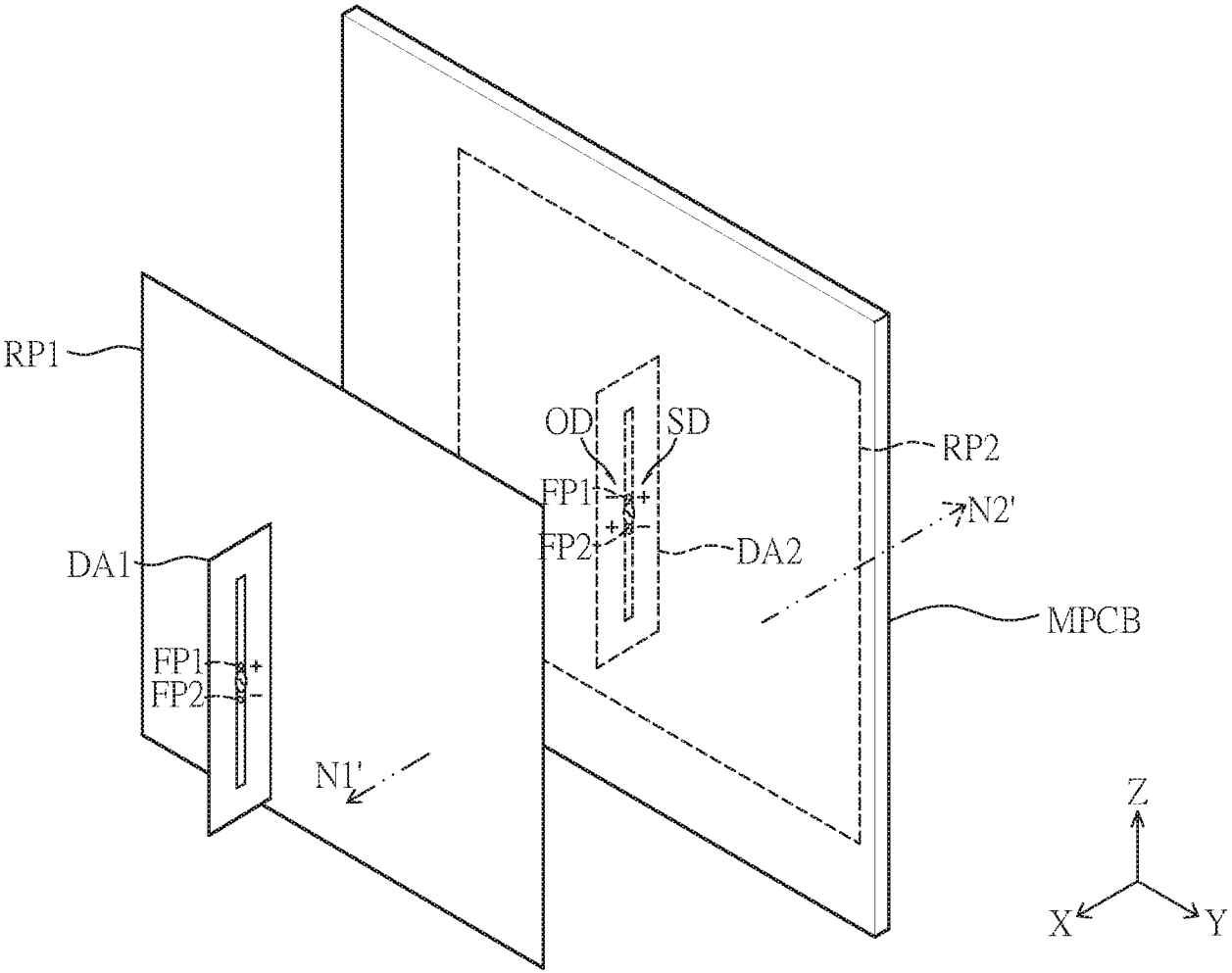
FIGS. 7A and 7B are respectively schematic diagrams showing an arrangement of two vertically polarized dipole antennas and an arrangement of two horizontally polarized dipole antennas according to an embodiment of the present disclosure.
Figure 7B:
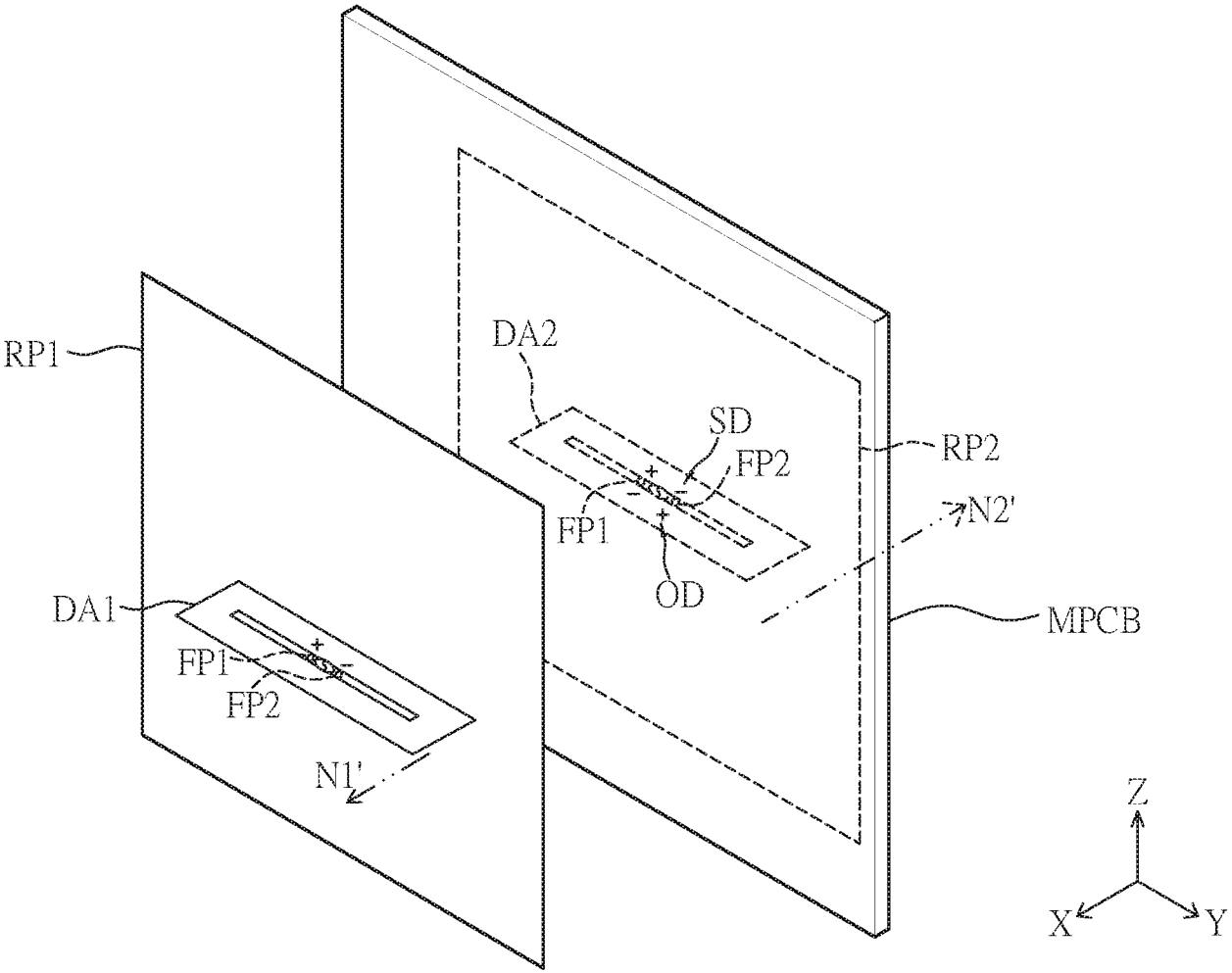

On the other hand, in addition to using patch antennas, dipole antennas can also be used to achieve a similar effect. Reference is made to FIGS. 7A and 7B, which are respectively schematic diagrams showing an arrangement of two vertically polarized dipole antennas and an arrangement of two horizontally polarized dipole antennas according to an embodiment of the present disclosure. In particular, polarization directions of the dipole antennas are set depending on orientation directions in which the dipole antennas are placed. Assuming that an XY plane is the ground, if orientation directions of the first dipole antenna DA1 and the second dipole antenna DA2 are perpendicular to the XY plane, the polarization directions of the first dipole antenna DA1 and the second dipole antenna DA2 are vertically polarized. If the orientation directions of the first dipole antenna DA1 and the second dipole antenna DA2 are parallel to the XY plane, the polarization directions of the first dipole antenna DA1 and the second dipole antenna DA2 are horizontally polarized. The first directional antenna 104 further includes a first reflector RP1 disposed between the first radiation unit A1 and the main circuit board MPCB, and the second directional antenna 106 further includes a second reflector RP2 disposed between the second radiation unit A2 and the main circuit board MPCB. In the present embodiment, the first radiation unit A1 and the second radiation unit A2 are a first dipole antenna DA1 and a second dipole antenna DA2, respectively, and a normal direction N1' of the first reflector RP1 is opposite to a normal direction N2' of the second reflector RP2.

Similarly, the first feeding portion F1 includes a first feeding point FP1 having a first feeding direction with respect to the first radiation unit A1, and the second feeding portion F2 includes a second feeding point FP2 having a second feeding direction with respect to the second radiation unit A2. As shown in FIG. 7A and FIG. 7B, when the first feeding direction is the same as the second feeding direction, it is expressed as a same polarization direction SD. If the first feeding direction is opposite to the second feeding direction, it is expressed as a reverse polarization direction OD. Positive (+) and negative (−) marks in FIG. 7A and FIG. 7B are used to indicate feeding points of the first dipole antenna DA1 and the second dipole antenna DA2, respectively.

In a case that the first feeding direction is the same as the second feeding direction, that is, in the same polarization direction SD, and when the polarization directions of the first dipole antenna DA1 and the second dipole antenna DA2 are horizontally polarized as shown in FIG. 7A, the first line length L1 is different from the second line length L2 to form a predetermined phase difference, and the predetermined phase difference ranges from 150 degrees to 210 degrees, and preferably, the predetermined phase difference can be 180 degrees. When the polarization directions of the first dipole antenna DA1 and the second dipole antenna DA2 are vertically polarized, the first line length L1 is the same as or different from the second line length L2 to form the predetermined phase difference, and the predetermined phase difference ranges from −30 degrees to +30 degrees, and preferably 0 degrees.

On the other hand, in a case that the first feeding direction is opposite to the second feeding direction, that is, in the reverse polarization direction OD, when the polarization directions of the first dipole antenna DA1 and the second dipole antenna DA2 are horizontally polarized, the first line length L1 is the same as the second line length L2 to form a predetermined phase difference, and the predetermined phase difference ranges from minus 30 degrees to plus 30 degrees, and preferably 0 degrees. When the polarization directions of the first dipole antenna DA1 and the second dipole antenna DA2 are vertically polarized, the first line length L1 is different from the second line length L2 to form the predetermined phase difference, and the predetermined phase difference ranges from 150 degrees to 150 degrees, and preferably 180 degrees.

Figure 8A:
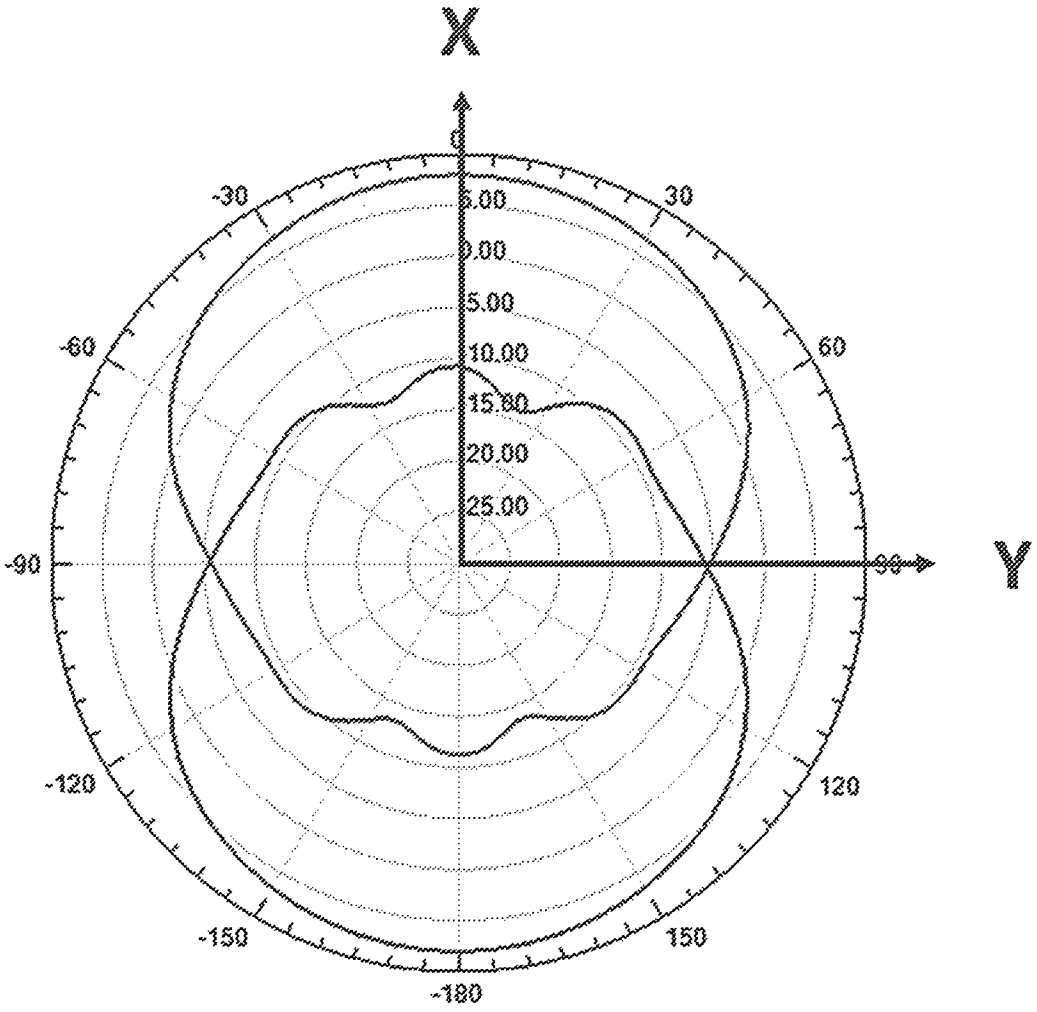
FIGS. 8A and 8B are respectively an individual pattern diagram and a schematic diagram of patterns fed with a predetermined phase difference of two dipole antennas according to an embodiment of the present disclosure.
Figure 8B:
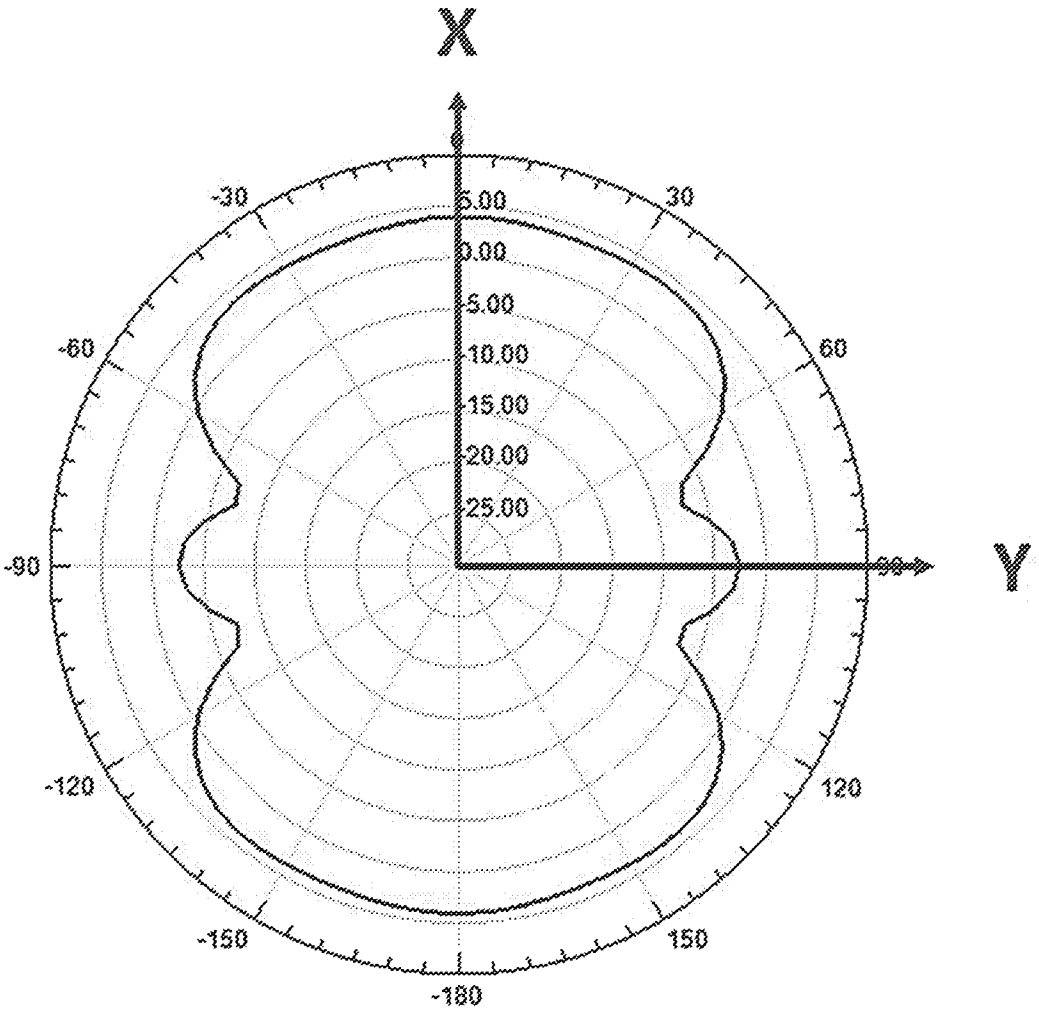

Reference is made to FIGS. 8A and 8B, which are respectively an individual pattern diagram and a schematic diagram of patterns fed with a predetermined phase difference of two dipole antennas according to an embodiment of the present disclosure. As shown in FIGS. 8A and 8B, when the architecture of the present disclosure is applied to double dipole antennas, dipole antennas of FIGS. 7A and 7B are taken as an example. After reflectors are additionally provided, the individual patterns are overlapped as shown in FIG. 8A. When the individual patterns are overlapped, sides of the pattern are the weakest. However, when the two dipole antennas are vertically polarized and the feeding directions are adjusted to be the same, when a predetermined pattern is formed with a predetermined phase difference, for example, 0 degrees, the pattern is as shown in FIG. 8B, and dead spots on the sides are obviously eliminated to form a near-omnidirectional pattern. Therefore, the present disclosure adopts a design including two directional antennas, and interference between subsystems with the same frequency in a single system is reduced by the high directivity of the single antenna to increase the distance of wireless transmission. Moreover, the characteristics of the antenna performance that are not affected by the main circuit board and the metal barrier can be utilized. Therefore, the two directional antennas can each be placed on the main circuit board or respectively on either side of any metal object, and connected by coaxial wires with different lengths and splitters, thereby feeding therefrom to generate a phase difference and allowing a pattern combined by the two antennas to be approximately an omnidirectional pattern.

Therefore, the present disclosure is applicable to obtain a wireless product without dead spot in transmission when only a single wireless transmitting receiver is provided and there is an issue relating to a printed circuit board or a metal barrier.

Figure 9:
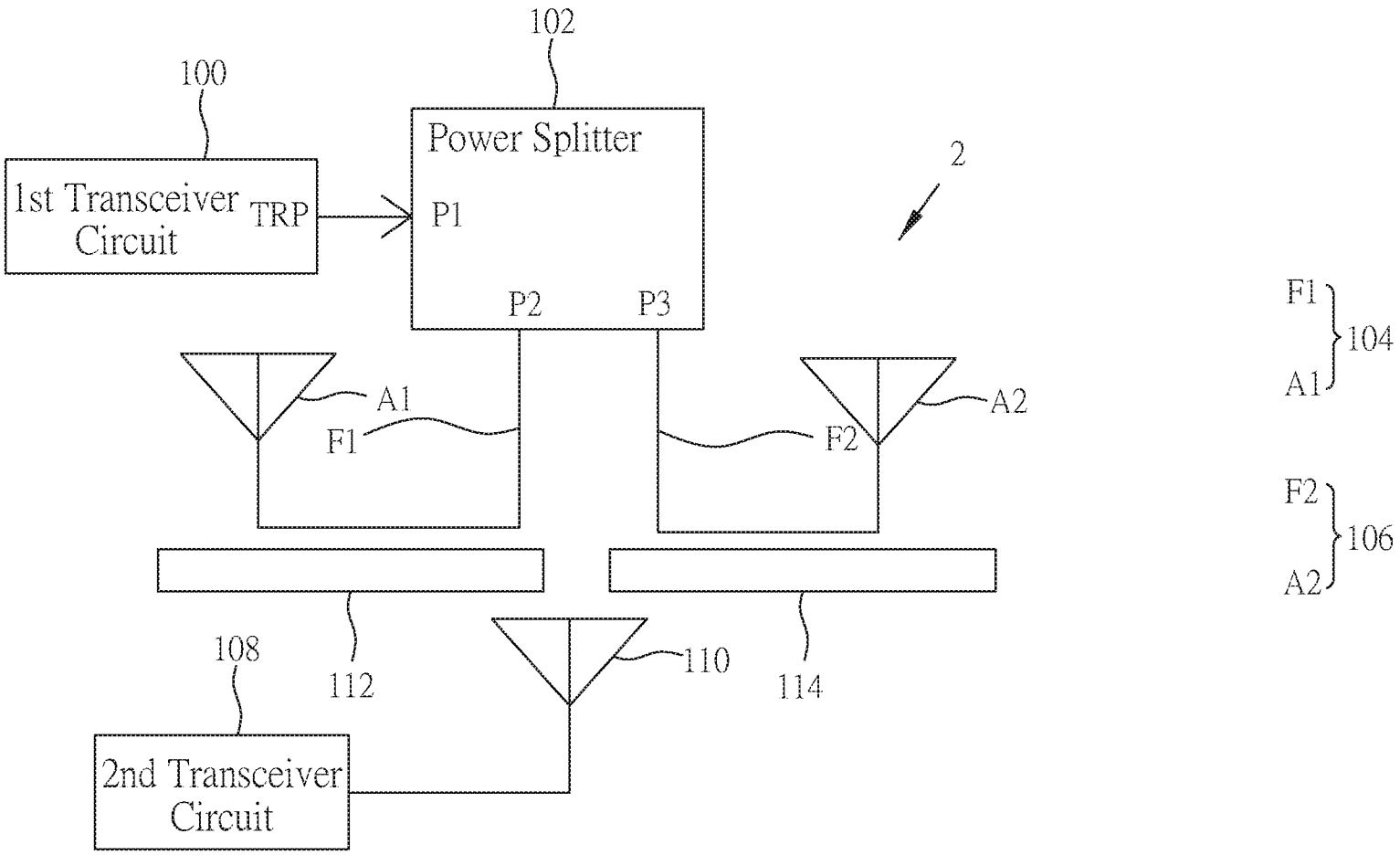
FIG. 9 is a block diagram of a wireless device according to another embodiment of the present disclosure.

Reference is made to FIG. 9, which is a block diagram of a wireless device according to another embodiment of the present disclosure. Another embodiment of the present disclosure provides a wireless device 2 including a first transceiver circuit 100, a power splitter 102, a first directional antenna 104, a second directional antenna 106, a second transceiver circuit 108, a third antenna 110, and a first isolator 112 and a second isolator 114. The first transceiver circuit 100 has a transmission and reception sharing port TRP, the power splitter 102 includes a first terminal P1, a second terminal P2 and a third terminal P3, and the first terminal P1 is connected to the transmission and reception sharing port TRP. It should be noted that, in the present embodiment, the first transceiver circuit 100 is a Bluetooth® transceiver circuit, and the second transceiver circuit 108 is a Wi-Fi access point transceiver circuit.

On the other hand, the second transceiver circuit 108 is configured to control the third antenna 110 to transmit and receive signals, the first directional antenna 104 and the second directional antenna 106 operate in a first operating frequency band, the third antenna 110 operates in a second operating frequency band, and the first operating frequency band partially overlaps the second operating frequency band. For example, the Bluetooth® and a 2.4G Wi-Fi AP are in the same ISM frequency band.

According to the above description, it can be seen that time division duplex (TDD) cannot support high-resolution music playback, so that the present disclosure uses frequency division duplexing (FDD) of 2.4G frequency band to reduce WLAN/Bluetooth® interference, and the Bluetooth® can continuously operate without needing to operate time-divisionally, and there is no need to consider the impact of TDD-induced interruptions when playing high-resolution music. Since the Bluetooth®/2.4G WLAN AP are in the same ISM band, it is necessary to increase an antenna isolation of the two to a certain level to avoid interruptions when playing through Bluetooth®.

Figure 10:
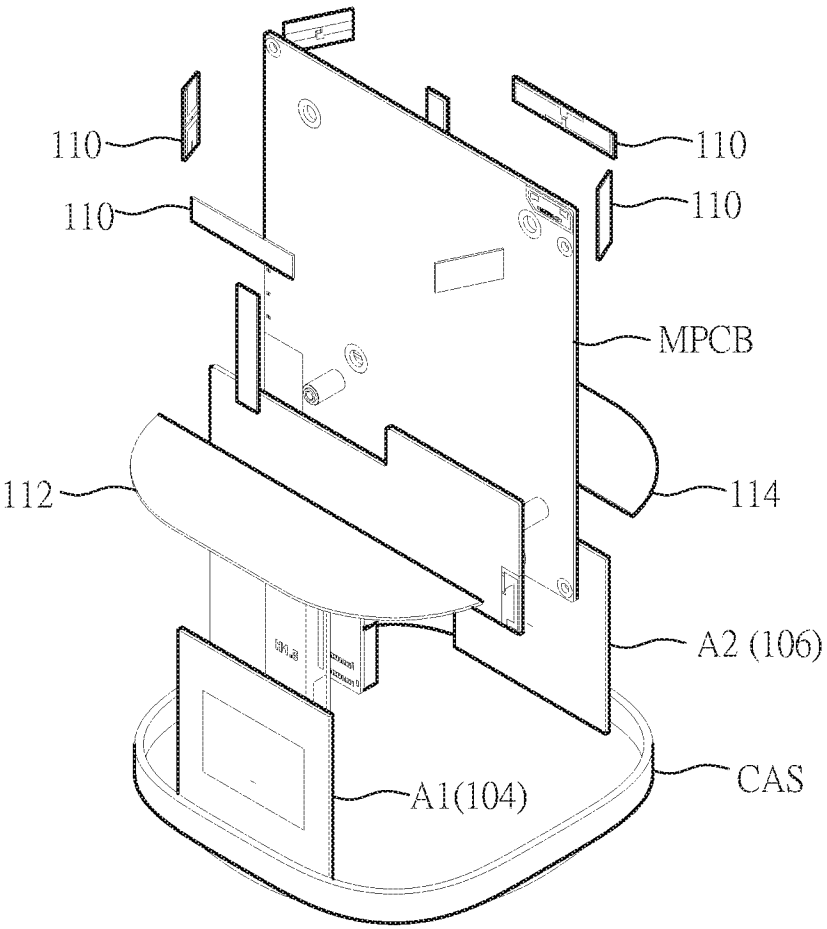
FIG. 10 is a schematic diagram of a wireless device according to another embodiment of the present disclosure.

Reference is made to FIG. 10, which is a schematic diagram of a wireless device according to another embodiment of the present disclosure. In the embodiment, the second transceiver circuit 108 is connected to the third antenna 110, the first isolator 112 is disposed between the third antenna 110 and the first radiation unit A1 of the first directional antenna 104, and the second isolator 114 is disposed between the third antenna 110 and the second radiation unit A2 of the second directional antenna 106. Here, the first isolator 112 is configured to provide a predetermined isolation between the third antenna 110 and the first directional antenna 104, and the second isolator 114 is configured to provide a predetermined isolation between the third antenna 110 and the second directional antenna 106.

In addition, the main circuit board MPCB, the first transceiver circuit 100, the power splitter 102, the first directional antenna 104, the second directional antenna 106, the second transceiver circuit 108, the third antenna 110, and the first isolator 112 and the second isolator 114 of the present embodiment can be disposed in a housing CAS. The isolators are provided in the wireless device to achieve the predetermined isolation, such that the wireless device of the present disclosure can increase a coexistence performance of systems with same frequencies when the size of the product is greatly reduced, and further allow the wireless device of the present disclosure to be more competitive.

Advantageous Effects of Embodiments

The present disclosure adopts a design including two directional antennas, and interference between subsystems with the same frequency in a single system is reduced by the high directivity of the single antenna to increase the distance of wireless transmission. Moreover, the characteristic of the antenna performance not being affected by the main circuit board and the metal barrier can be utilized. Therefore, the two directional antennas can be placed on the main circuit board or respectively on either side of any metal object, and connected by coaxial wires with different lengths and splitters, thereby feeding therefrom to generate a predetermined phase difference and allowing a pattern combined by the two directional antennas to be approximately an omnidirectional pattern. Thereby, a wireless device functioning as both a smart speaker and a wireless access point AP can be achieved.

In addition, isolators are further provided in the wireless device to achieve a predetermined isolation, and the wireless device of the present disclosure can increase a coexistence performance of systems when the size of the product is greatly reduced, and further allow the wireless device of the present disclosure to be more competitive.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A wireless device, comprising:

a first transceiver circuit having a transmission and reception sharing port;

a power splitter including a first end, a second end and a third end, wherein the first end is connected to the transmitting and receiving sharing port;

a first directional antenna connected to the second end of the power splitter, and having a first feeding portion and a first radiation unit, wherein the first feeding portion has a first line length;

a second directional antenna connected to the third end of the power splitter, and having a second feeding portion and a second radiation unit, wherein the second feeding portion has a second line length, and a predetermined phase difference is provided between the first directional antenna and the second directional antenna;

a main circuit board disposed between the first radiation unit and the second radiation unit, wherein the first transceiver circuit forms, through the first directional antenna, the second directional antenna and the predetermined phase difference, a predetermined pattern to transmit or receive signals, and the predetermined pattern has omnidirectionality, wherein the first transceiver circuit is disposed on the main circuit board, and a radiation direction of the first directional antenna is different from a radiation direction of the second directional antenna, wherein the first radiation unit and the second radiation unit are a first patch antenna and a second patch antenna, respectively, and wherein the first feeding portion includes a first feeding point having a first feeding direction with respect to the first radiation unit, the second feeding portion includes a second feeding point having a second feeding direction with respect to the second radiation unit, and the first feeding direction is the same as the second feeding direction, wherein when polarization directions of the first patch antenna and the second patch antenna are horizontally polarized, the first line length and the second line length are different to form the predetermined phase difference, and the predetermined phase difference ranges from 150 degrees to 210 degrees, and wherein when the polarization directions of the first patch antenna and the second patch antenna are vertically polarized, the first line length is the same as or different from the second line length to form the predetermined phase difference, and the predetermined phase difference ranges from −30 degrees to +30 degrees.

2. The wireless device according to claim 1, wherein the first directional antenna has a first pattern, the second directional antenna has a second pattern, and the predetermined pattern is different from the first pattern and the second pattern.

3. The wireless device according to claim 1, wherein a normal direction the first patch antenna is opposite to a normal direction of the second patch antenna.

4. The wireless device according to claim 1, further comprising:

a second transceiver circuit;

a third antenna connected to the second transceiver circuit;

a first isolator disposed between the third antenna and the first directional antenna; and a second isolator disposed between the third antenna and the second directional antenna, wherein the first isolator is configured to provide a predetermined isolation between the third antenna and the first directional antenna, and the second isolator is configured to provide a predetermined isolation between the third antenna and the second directional antenna.

5. The wireless device according to claim 4, wherein the second transceiver circuit is configured to control the third antenna to transmit and receive signals, the first directional antenna and the second directional antenna operate in a first operating frequency band, the third antenna operates in a second operating frequency band, and the first operating frequency band partially overlaps the second operating frequency band.

6. The wireless device according to claim 4, wherein the first transceiver circuit is a Bluetooth® transceiver circuit and the second transceiver circuit is a Wi-Fi transceiver circuit.

7. A wireless device, comprising:

a first transceiver circuit having a transmission and reception sharing port;

a power splitter including a first end, a second end and a third end, wherein the first end is connected to the transmitting and receiving sharing port;

a first directional antenna connected to the second end of the power splitter, and having a first feeding portion and a first radiation unit, wherein the first feeding portion has a first line length;

a second directional antenna connected to the third end of the power splitter, and having a second feeding portion and a second radiation unit, wherein the second feeding portion has a second line length, and a predetermined phase difference is provided between the first directional antenna and the second directional antenna;

a main circuit board disposed between the first radiation unit and the second radiation unit;

a second transceiver circuit;

a third antenna connected to the second transceiver circuit;

a first isolator disposed between the third antenna and the first directional antenna; and a second isolator disposed between the third antenna and the second directional antenna, wherein the first isolator is configured to provide a predetermined isolation between the third antenna and the first directional antenna, and the second isolator is configured to provide a predetermined isolation between the third antenna and the second directional antenna, wherein the first transceiver circuit forms, through the first directional antenna, the second directional antenna and the predetermined phase difference, a predetermined pattern to transmit or receive signals, and the predetermined pattern has omnidirectionality, and wherein the first transceiver circuit is disposed on the main circuit board, and a radiation direction of the first directional antenna is different from a radiation direction of the second directional antenna.

8. A wireless device, comprising:

a first transceiver circuit having a transmission and reception sharing port;

a power splitter including a first end, a second end and a third end, wherein the first end is connected to the transmitting and receiving sharing port;

a first directional antenna connected to the second end of the power splitter, and having a first feeding portion and a first radiation unit, wherein the first feeding portion has a first line length;

a second directional antenna connected to the third end of the power splitter, and having a second feeding portion and a second radiation unit, wherein the second feeding portion has a second line length, and a predetermined phase difference is provided between the first directional antenna and the second directional antenna;

a main circuit board disposed between the first radiation unit and the second radiation unit, wherein the first transceiver circuit forms, through the first directional antenna, the second directional antenna and the predetermined phase difference, a predetermined pattern to transmit or receive signals, and the predetermined pattern has omnidirectionality, wherein the first transceiver circuit is disposed on the main circuit board, and a radiation direction of the first directional antenna is different from a radiation direction of the second directional antenna, wherein the first radiation unit and the second radiation unit are a first patch antenna and a second patch antenna, respectively, wherein the first feeding portion includes a first feeding point having a first feeding direction with respect to the first radiation unit, and the second feeding portion includes a second feeding point having a second feeding direction with respect to the second radiation unit, and the first feeding direction is opposite to the second feeding direction, wherein when polarization directions of the first patch antenna and the second patch antenna are horizontally polarized, the first line length is the same as or different from the second line length to form the predetermined phase difference, and the predetermined phase difference ranges from −30 degrees to +30 degrees, and wherein when the polarization directions of the first patch antenna and the second patch antenna are vertically polarized, the first line length and the second line length are different to form the predetermined phase difference, and the predetermined phase difference ranges from 150 degrees to 210 degrees.

9. A wireless device, comprising:

a first transceiver circuit having a transmission and reception sharing port;

a power splitter including a first end, a second end and a third end, wherein the first end is connected to the transmitting and receiving sharing port;

a first directional antenna connected to the second end of the power splitter, and having a first feeding portion and a first radiation unit, wherein the first feeding portion has a first line length;

a second directional antenna connected to the third end of the power splitter, and having a second feeding portion and a second radiation unit, wherein the second feeding portion has a second line length, and a predetermined phase difference is provided between the first directional antenna and the second directional antenna;

a main circuit board disposed between the first radiation unit and the second radiation unit, wherein the first transceiver circuit forms, through the first directional antenna, the second directional antenna and the predetermined phase difference, a predetermined pattern to transmit or receive signals, and the predetermined pattern has omnidirectionality, wherein the first transceiver circuit is disposed on the main circuit board, and a radiation direction of the first directional antenna is different from a radiation direction of the second directional antenna, and wherein the first directional antenna further includes a first reflector disposed between the first radiation unit and the main circuit board, and the second directional antenna further includes a second reflector disposed between the second radiation unit and the main circuit board, wherein the first radiation unit and the second radiation unit are a first dipole antenna and a second dipole antenna, respectively, and a normal direction of the first reflector is opposite to a normal direction of the second reflector.

10. The wireless device according to claim 9, wherein the first feeding portion includes a first feeding point having a first feeding direction with respect to the first radiation unit, the second feeding portion includes a second feeding point having a second feeding direction with respect to the second radiation unit, and the first feeding direction is the same as the second feeding direction, wherein when polarization directions of the first dipole antenna and the second dipole antenna are horizontally polarized, the first line length and the second line length are different to form the predetermined phase difference, and the predetermined phase difference ranges from 150 degrees to 210 degrees, and wherein when the polarization directions of the first dipole antenna and the second dipole antenna are vertically polarized, the first line length is the same as or different from the second line length to form the predetermined phase difference, and the predetermined phase difference ranges from −30 degrees to +30 degrees.

11. The wireless device according to claim 9, wherein the first feeding portion includes a first feeding point having a first feeding direction with respect to the first radiation unit, the second feeding portion includes a second feeding point having a second feeding direction with respect to the second radiation unit, and the first feeding direction is opposite to the second feeding direction, wherein when polarization directions of the first dipole antenna and the second dipole antenna are horizontally polarized, the first line length is the same as or different from the second line length to form the predetermined phase difference, and the predetermined phase difference ranges from −30 degrees to +30 degrees, and wherein when the polarization directions of the first dipole antenna and the second dipole antenna are vertically polarized, the first line length and the second line length are different to form the predetermined phase difference, and the predetermined phase difference ranges from 150 degrees to 210 degrees.

* * * * *